US008418411B2

(12) United States Patent
Garcia, Velez Y Cortazar

(10) Patent No.: US 8,418,411 B2
(45) Date of Patent: Apr. 16, 2013

(54) INTEGRAL, INDUSTRIALIZED MODULAR DWELLING SYSTEM

(76) Inventor: Carlos Garcia, Velez Y Cortazar, Lomas de Chapultepec (MX)

( * ) Notice: Subject to any disclaimer, the term of this patent is extended or adjusted under 35 U.S.C. 154(b) by 797 days.

(21) Appl. No.: 12/097,701

(22) PCT Filed: Nov. 29, 2006

(86) PCT No.: PCT/MX2006/000136

§ 371 (c)(1),
(2), (4) Date: Dec. 2, 2008

(87) PCT Pub. No.: WO2007/069877

PCT Pub. Date: Jun. 21, 2007

(65) Prior Publication Data

US 2009/0145079 A1 Jun. 11, 2009

(30) Foreign Application Priority Data

Dec. 16, 2005 (MX) ..... PA/a2005/013858

(51) Int. Cl.
*E04H 5/02* (2006.01)

(52) U.S. Cl.
USPC ..... 52/79.1; 52/79.5; 52/79.12; 52/64

(58) Field of Classification Search ..... 52/79.1, 52/79.5, 79.9, 143, 745.15, 745.19, 648.1, 52/234

See application file for complete search history.

(56) References Cited

U.S. PATENT DOCUMENTS

| | | | | | |
|---|---|---|---|---|---|
| 3,762,112 | A | * | 10/1973 | Evans et al. | 52/79.8 |
| 3,785,314 | A | * | 1/1974 | Scanlan | 114/266 |
| 4,180,233 | A | * | 12/1979 | Johnson | 249/144 |
| 4,773,523 | A | * | 9/1988 | Hansen et al. | 414/799 |
| 5,081,805 | A | * | 1/1992 | Jazzar | 52/79.2 |
| 6,067,771 | A | * | 5/2000 | Blankenship | 52/745.2 |
| 6,253,504 | B1 | * | 7/2001 | Cohen et al. | 52/143 |
| 2010/0088975 | A1 | * | 4/2010 | Klersy | 52/79.11 |

FOREIGN PATENT DOCUMENTS

| | | | | |
|---|---|---|---|---|
| JP | 01280181 | A | * | 11/1989 |
| JP | 04343977 | A | * | 11/1992 |
| JP | 05071230 | A | * | 3/1993 |
| JP | 05263529 | A | * | 10/1993 |
| JP | 06042179 | A | * | 2/1994 |

* cited by examiner

*Primary Examiner* — Phi Dieu Tran A
(74) *Attorney, Agent, or Firm* — Sughrue Mion, PLLC

(57) ABSTRACT

The invention relates to an integral, industrialized, modular dwelling system which is based on modular, multi-functional, three-dimensional modules that are made from reinforced concrete. The modules, roofing and components are produced in a semi-automated covered plant in which the modules are first cast and set and subsequently provided with integrated finishes, installations, accessories, partitions and details. The invention also relates to a method for constructing the modules, a retractable flexible mold for casting said modules and a method for the on-site building of dwellings using the inventive three-dimensional modules.

4 Claims, 21 Drawing Sheets

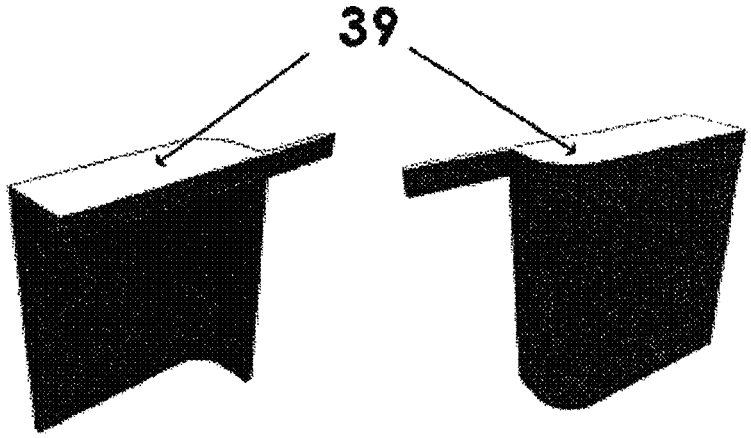
Figure 12 A
Figure 12 B
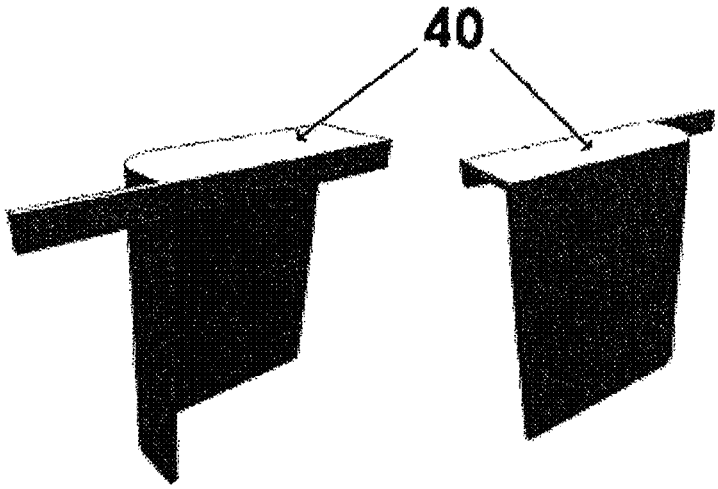
Figure 13 A
Figure 13 B

INTEGRAL, INDUSTRIALIZED MODULAR DWELLING SYSTEM

FIELD OF THE INVENTION

The present invention refers to an integral, industrialized, modular dwelling system which is based on modular, multi-functional, three-dimensional modules that are made from reinforced concrete, thus optimizing its earthquake-resistant, monolithic structure, through ribs and cells in walls and slabs. The coverings and mezzanines use a "Structural Geometry" and Vaults. A variety of very high esthetical and social sets are achieved, and having superior durability.

In the system of the invention, the manufacture of modules, coverings and components is performed at a semi-automated covered plant, integrating finishes, installations, accessories, metal work, partitions and high quality details. They are afterwards shipped to site already for being assembled, thus creating single-level dwellings or several floor buildings.

BACKGROUND OF THE INVENTION

The integral, Industrialized, Modular dwelling system which is intended to be used for serial dwelling construction has no comparison to any of the current constructive systems, in that the concrete dwelling construction by the present invention is done either in situ using metallic molds or producing at the plant prefabricated panels which are assembled on-site in order to form the dwellings' walls and slabs.

The integral, industrialized, modular dwelling system of the present invention has the feature that in a plant or factory building, complete rooms having floor and walls are prefabricated from a steel mold actuated by means of hydraulic jacks such that with the use of a steam curing four castings are achieved within 24 hours, as opposed to the traditional mold system for on-site casting, wherein a casting is achieved every 24 hours. Fixtures, finishes and metal work can be integrated on factory, such that on the construction-site, the working is reduced to connections between rooms of the dwellings and their roofs.

The complete rooms will be assembled on-site by "dry" connections based on screwed joints; as opposed to the traditional panel-based prefabricated systems in which the joints are "wet" that is based on small castings, further in the traditional systems the panels are sent without finishes, the fixtures are made on-site as well as the metal work.

In the present integral, industrialized, modular dwelling system, as opposed to the existing constructive systems, modules are produced which include all the elements (structure, finishes, wood finishing, etc.) having a superior quality, thus saving 80% manpower and the construction time is speeded up to 70%.

By performing the manufacture process inside a closed plant, work can be done at any time of the year, with any weather, having the guaranteed production under control and with the highest quality.

From a formal point of view, the current dwelling edification systems are rigid and repetitive, thus falling into an esthetical monotony with no individuality. The integral, industrialized, modular dwelling system of the present invention, on the contrary, humanizes the dwelling due to the huge variety of components that are produces at the factory, these can be exchanged resulting in countless formal options, of textures and color, thus giving the individuality each dwelling requires.

In the current systems there is a need for further afterward working in order to install the finishes, the integral, industrialized, modular dwelling system allows to obtain every kind of textures and integral colors without additional on-site working.

Currently, in the commonly used systems, there is a need for constant maintenance in order for the finishes to preserve their original features. With the present integral, industrialized, modular dwelling system, by being integral finishes there is no need for maintenance work and their durability is for the house entire useful life.

The future growth of dwellings is very expensive and complex, thus creating every kind of social and urban image problems. The integral, industrialized, modular dwelling system allows the owners to place an order for the module they need, the modules being delivered complete either they are residential (habitable) or technical (restrooms) and are assembled at a three hour time period, which makes them completely unique.

In the following there is a description of some of the constructive systems which are most commonly used nowadays and it follows a brief comparison thereof with the system object of the present invention.

Block Walls

The construction of block walls is a process wherein manually and on-site said walls are gradually constructed from small concrete masonry pieces which are joined with mortar.

With the integral, industrialized, modular dwelling system of the present invention, the work is moved to the factory and with the mold casting processes, the construction of said walls is reduced from a week to a period of three to four hours, with millimetric tolerances in its execution. The concrete and steel used with this system are similar to those of the block walls but with an important reduction in the execution times and at a substantial increase of the execution quality.

On-Site Cast Concrete Walls

Poured concrete walls are solid walls which require a centering or formwork that is gradually moved at the construction-site for the walls' casting.

With the integral, industrialized, modular dwelling system object of the present invention, hollow walls can be constructed thus achieving concrete savings of up to 40% without reducing the wall's strength and with dimensional tolerances of tenths of a millimeter. Further, the integral, industrialized, modular dwelling system produces concrete of several colors and textures with which integral finishes are obtained. The textures are applied in different ways from the centering with factory quality.

On-Site Cast Concrete Slabs

On-site cast concrete slabs are solid having a 10 cm normal thickness, which need several days for their shoring to be removed after casting.

In the integral, industrialized, modular dwelling system object of the present invention the slabs (foundation and roofing) are prefabricated having a domed and ribbed structure. For them use is made of Structural Geometry, which allows concrete savings of up to 40% and due to the mold manufacturing process an apparent finish which needs no gypsum or tyrol layer application is achieved. A slab of this kind is self contained and needs no waiting time after its installation, and further when being manufactured the curing is done with a heating system, which renders it much more fast.

Joist and Flooring Block Slabs

These slabs require joists, block slabs and on-site casting of a concrete compression layer, the main difference with the slabs of the integral, industrialized, modular dwelling system of the present invention being that in the latter the material equivalent to the flooring slab is saved and by being prefabricated members and apparent finish is achieved that, as opposed to joist and flooring slab needs no additional finishing work.

SUMMARY OF THE INVENTION

The core principle of the present invention system is to significantly reduce the concrete, steel and manpower used in dwelling construction, as well as to reduce manufacturing time, thus guaranteeing a high quality and millimetric precision with integral finishes, prefabricated fixtures and standardized components. The peculiar features of the modules are among others their structural multifunctionality (thickness variation and cells in walls), lego type modulation, facility concentration, functional space generation, architectural detail variation, slab-flooring dual function, and the variability of the structural geometry vaults. The urban components are produced with the same criterion of "structural air" always reducing material consumption.

It is therefore an object of the present invention a concrete module factory for manufacturing high quality and high durability economical dwellings.

It is another object of the present invention an industrialized process for constructing a series of concrete three-dimensional modules of a residential and technical character for manufacturing dwellings.

Other object of the invention is to provide a flexible mold for manufacturing three-dimensional modules of residential and technical character for building dwellings.

Another object of the present invention is a method for in situ edification of dwellings based on prefabricated concrete three-dimensional modules.

All the abovementioned objects of the invention jointly make up a single inventive concept grouped by the overall concept of integral, industrialized dwelling system.

These and other objects which will be apparent are now disclosed and illustrated in the figures accompanying this specification.

DISCLOSURE OF THE DRAWINGS

The invention shall be disclosed in detail with reference to the drawings, in which:

FIGS. 12A and 12B are views of a built-in closet component for a right residential module.

FIGS. 13A and 13B correspond to a built-in closet component for a left residential module.

Figure 14:
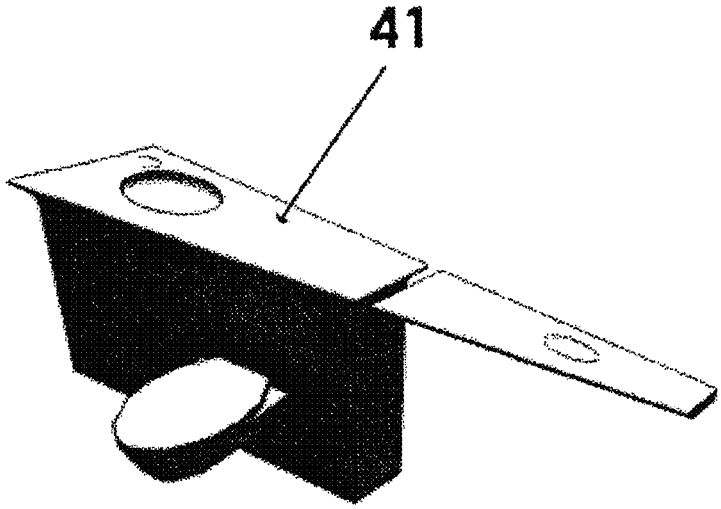

FIG. 14 is a perspective view of a kit-restroom component for a left technical module.

Figure 15:
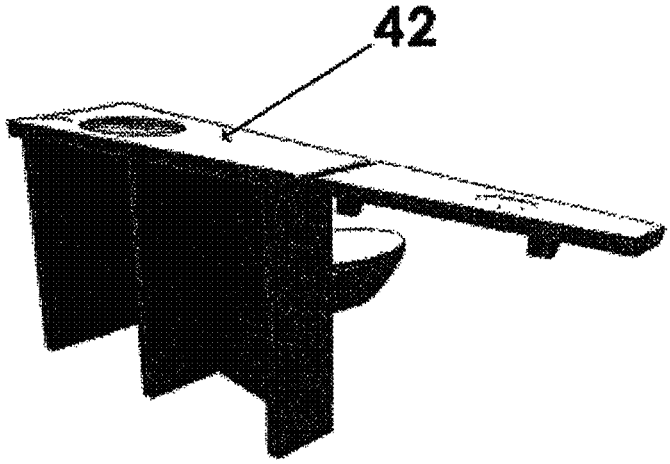

FIG. 15 is a perspective view of a kit-restroom component for a right technical module.

Figure 16:
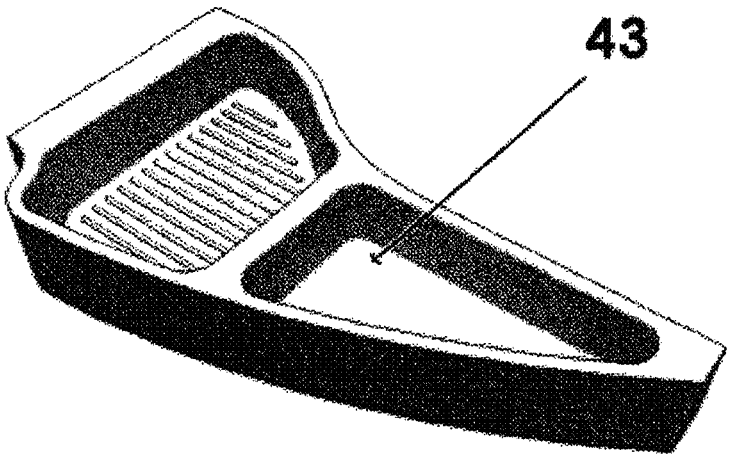

FIG. 16 is a top perspective view of a washing sink for a right technical module.

Figure 17:
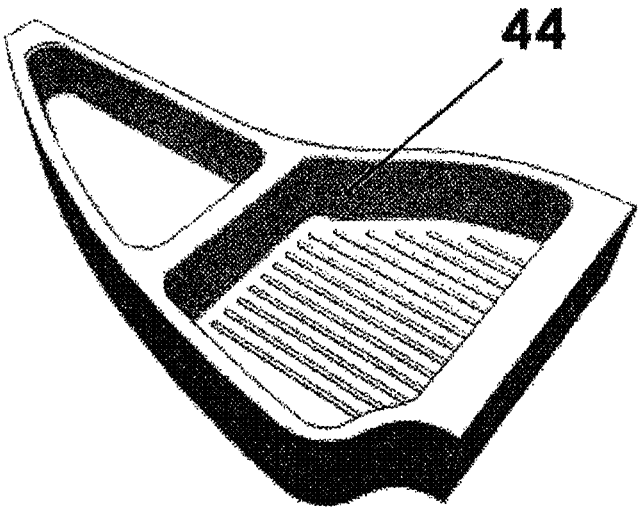

FIG. 17 is a top perspective view of a washing sink for a left technical module.

Figure 18:
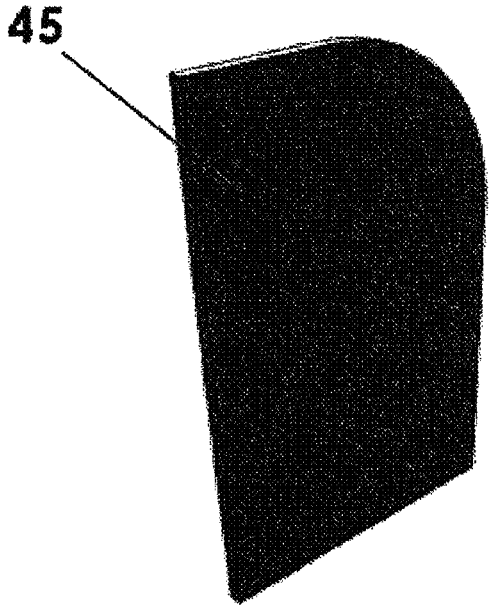

FIG. 18 is a perspective view of a courtyard wall component.

Figure 19:
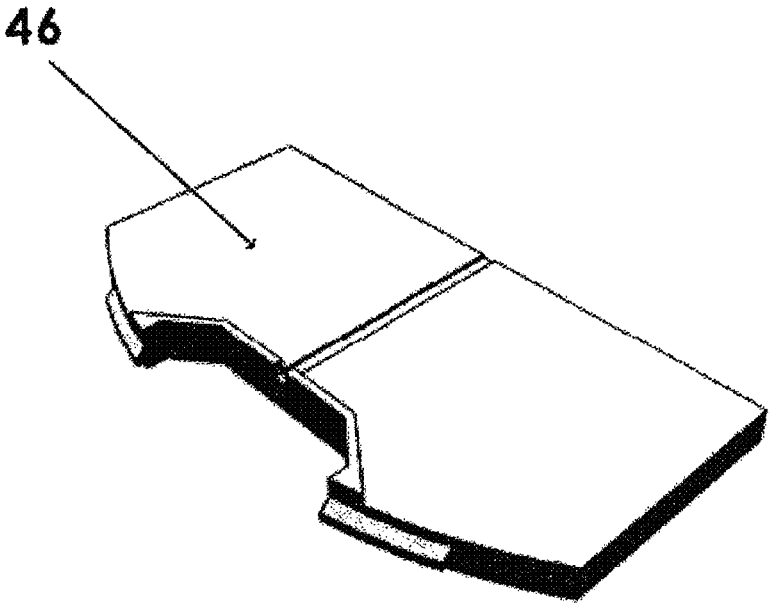

FIG. 19 is a perspective view of a patio roof component.

Figure 20:
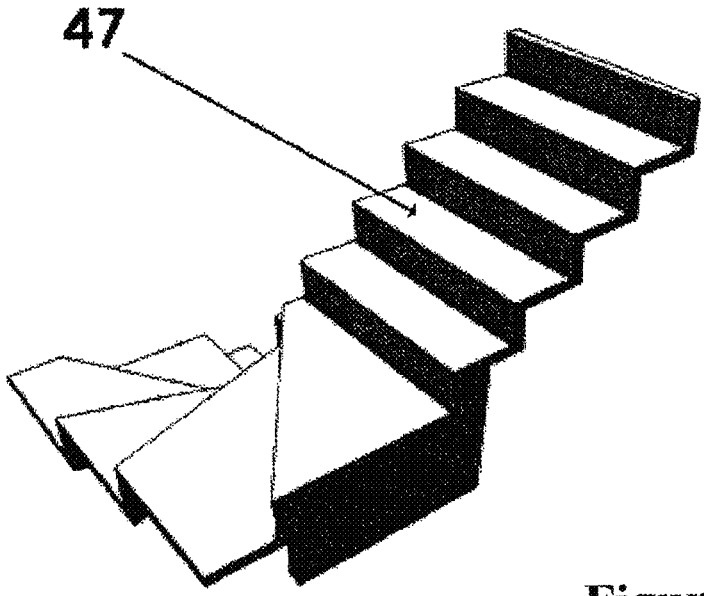

FIG. 20 is a perspective view of a stair component for a left residential module.

Figure 21:
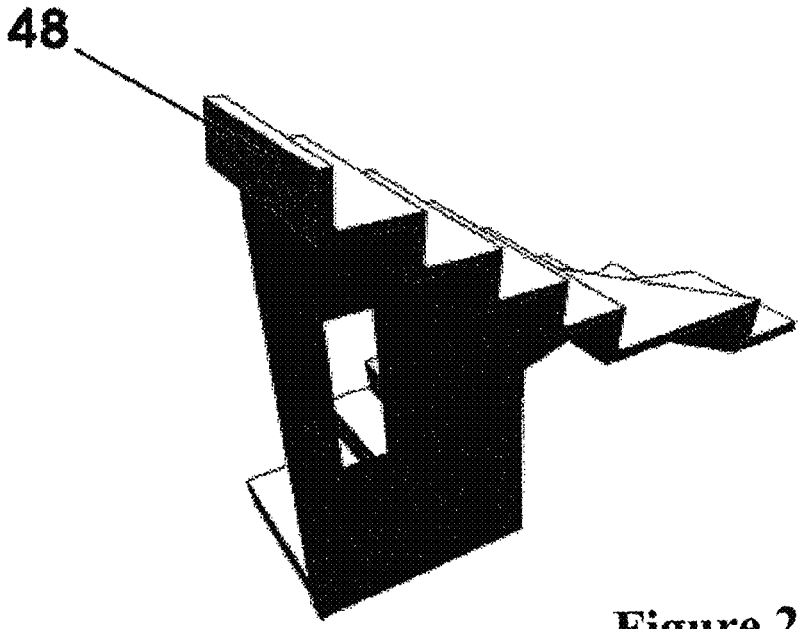

FIG. 21 is a perspective view of a stair component for a right residential module.

Figure 22:
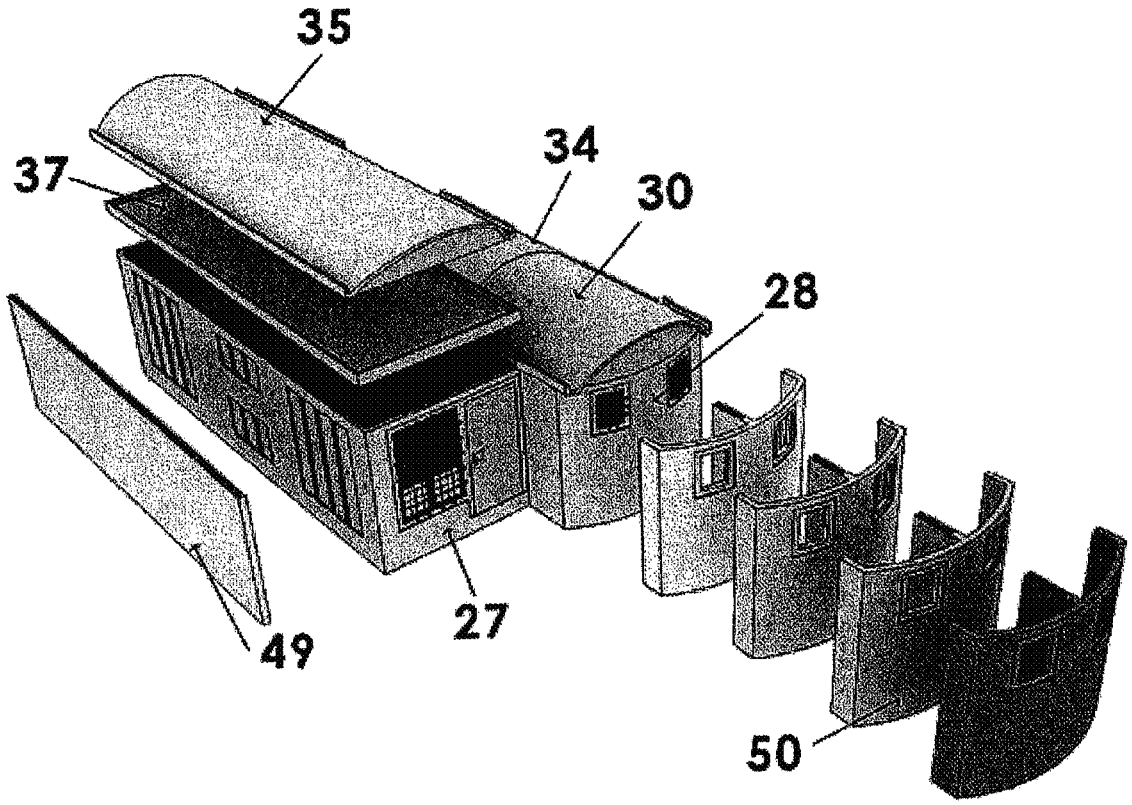

FIG. 22 is a perspective view of a modular dwelling in which the possibility of using different wall, facade and slab embodiments for giving individuality to each dwelling.

Figures 23A, 23B:
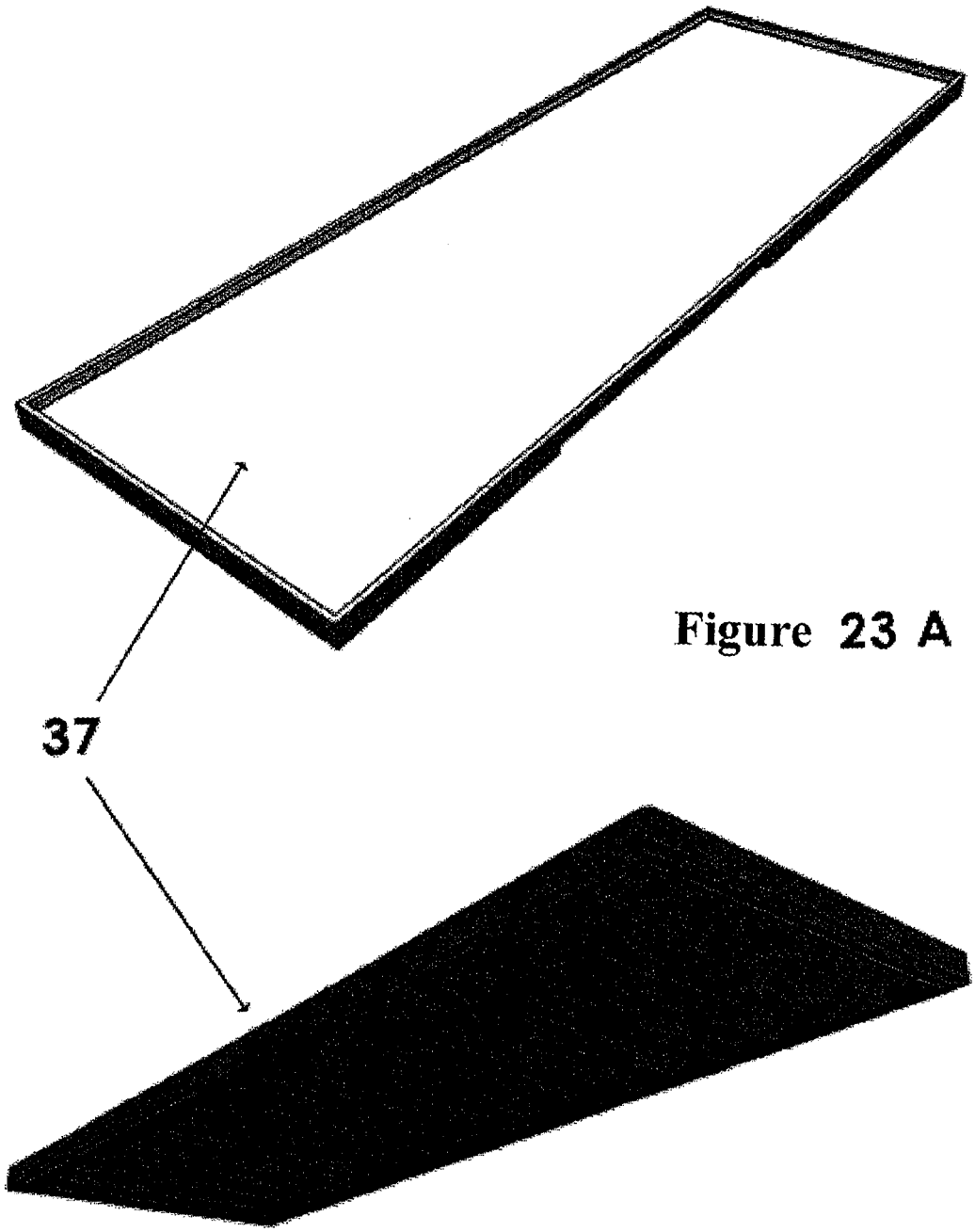

FIGS. 23A and 23B are lower and upper perspective views, respectively, of a slab for a residential module.

Figure 24:
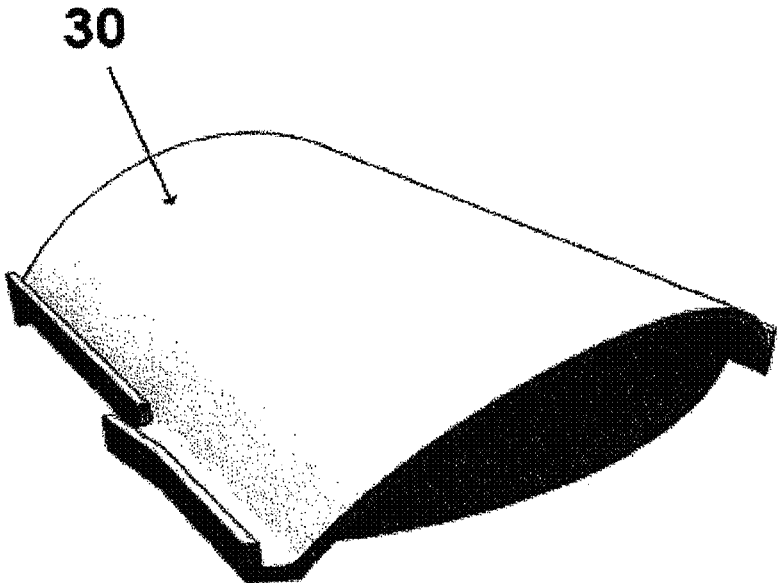

FIG. 24 is a perspective view of a technical module vault slab.

Figure 25A:
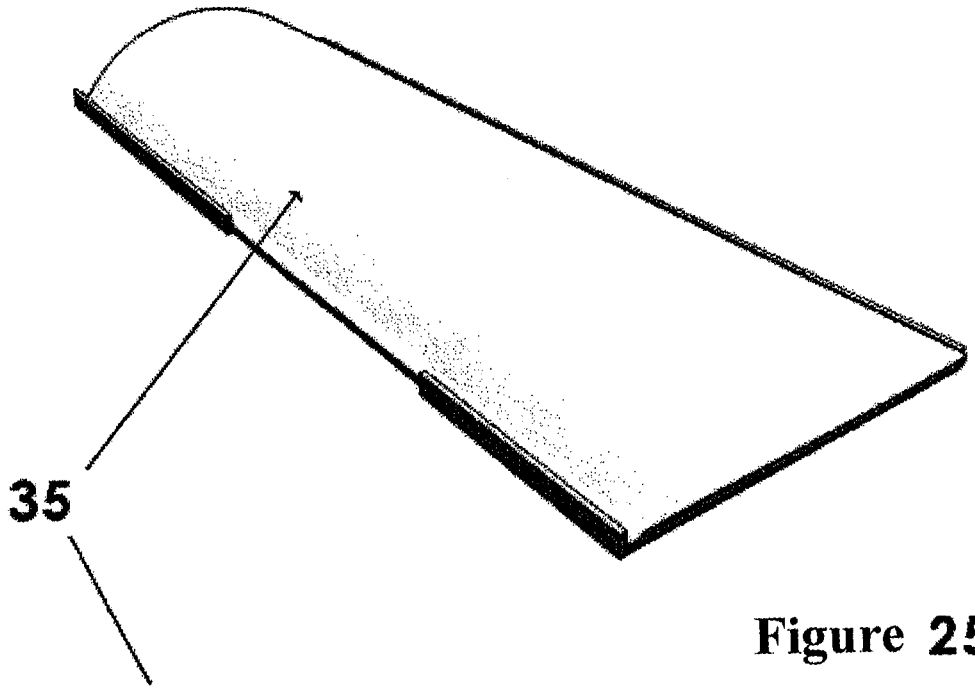
Figure 25B:
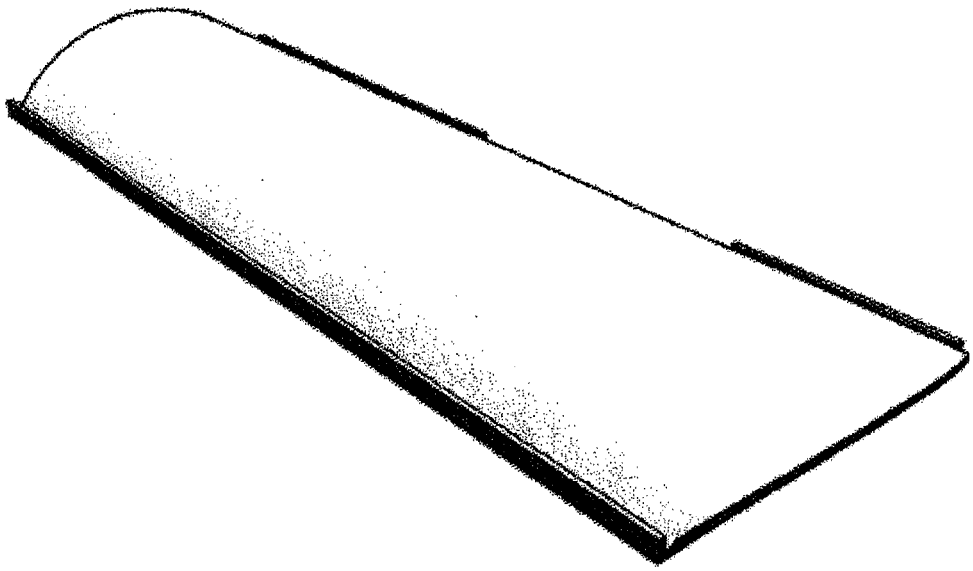

FIGS. 25A and 25B are views of a right and left residential module slab, respectively.

Figure 26:
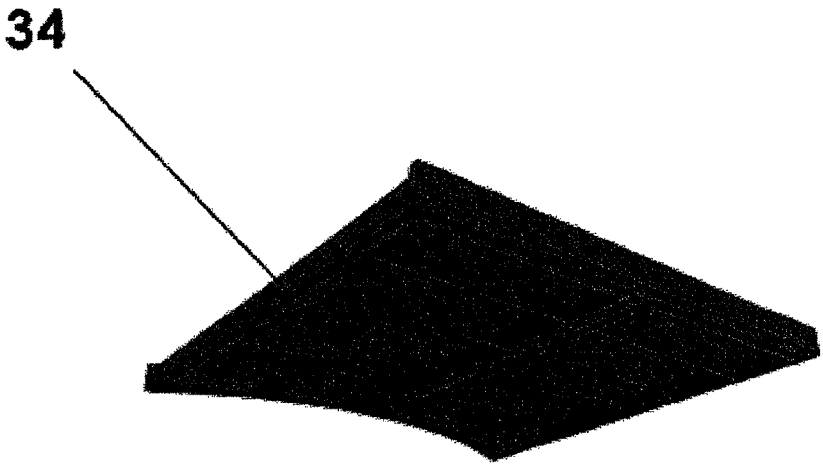

FIG. 26 is a lower view of a technical module slab.

Figure 27A:
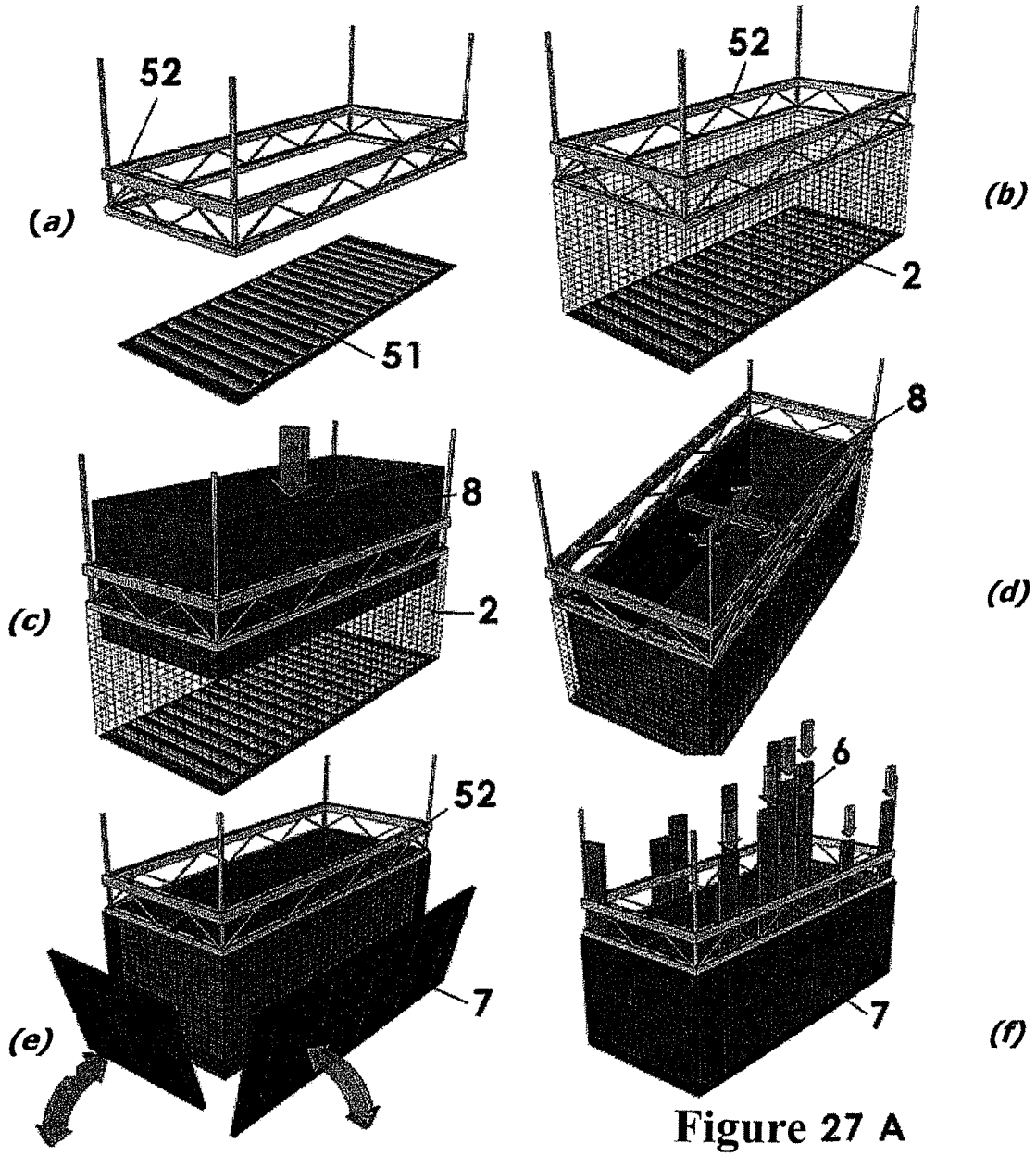
Figure 27B:
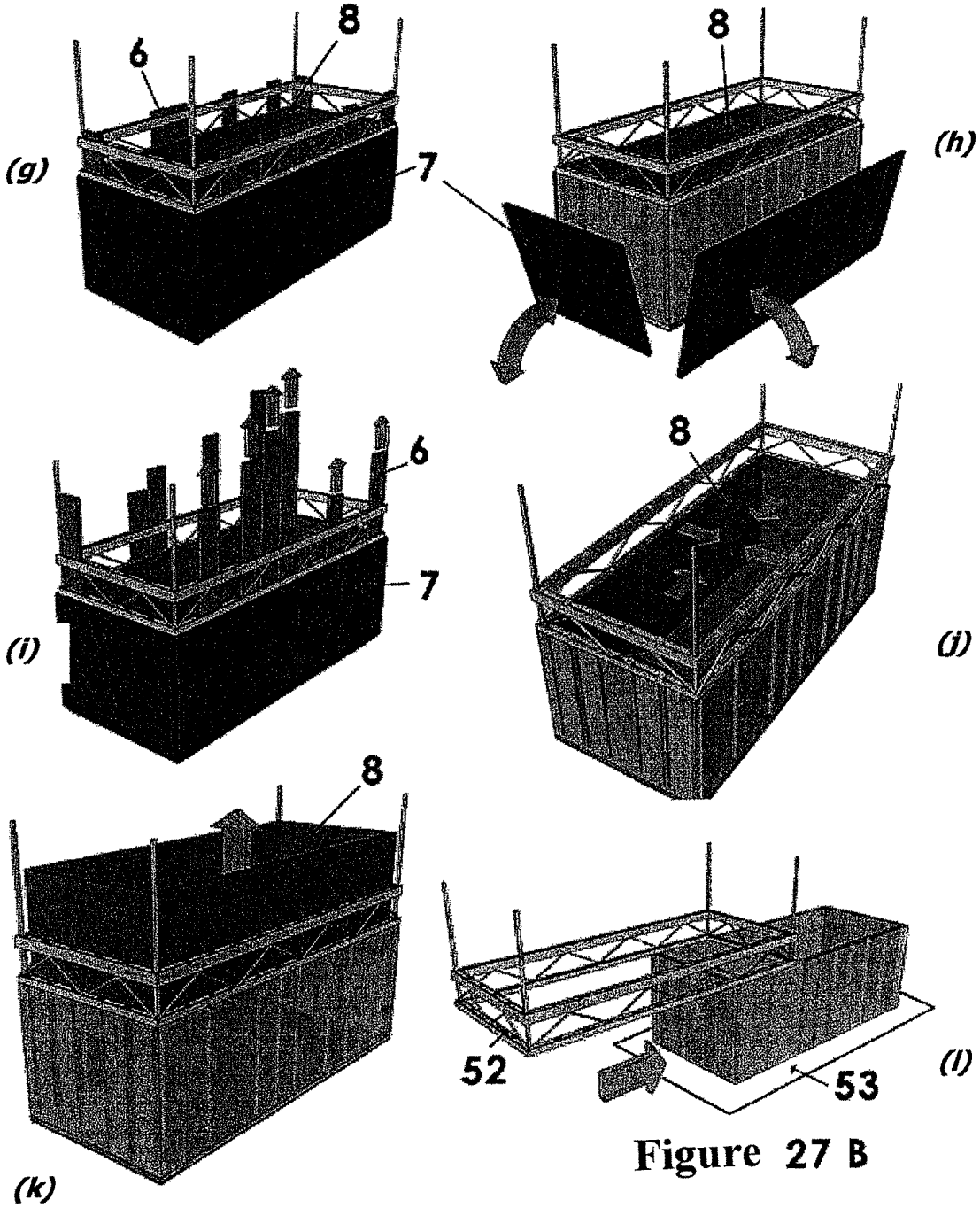

FIGS. 27A and 27B depict the series of steps that are performed for constructing a module according to the present invention.

PROCESS AND FACILITIES FOR MODULE CONSTRUCTION

House manufacturing is made up by high tech equipment, thus reaching the highest levels of precision, quality and cost. Its backbone is constituted on one side by the mechanic actuation steel molds both for boundaries, metallic brushes (conical elements) with unique design for constructing three-dimensional modules with honeycomb and ribbed walls, as well as vaulted slabs having varying thickness and shapes thus creating high flexibility in their combination, and on other side, the special concrete production system for achieving surfaces and constructive details, as well as the peripheral equipment for cutting, enabling and soldering. The use of platforms allows an optimal handling of the modules as it avoids extraordinary efforts in the structures of the concrete curing process. Also, this process is enhanced by integrating curing chambers. The modules are connected each other by bridle joints in slabs and walls, which allows an easy on-site assembly, dispensing with construction works on-site, and thus creating a system free from assemblies and screwed joints.

The originality and novelty of the present invention system consists of achieving three-dimensional modules with monolithically cast walls and slabs having void cells thus optimizing their assemblies and using the same molds for constructing buildings. Another novel aspect is the integration of modular and varying dwelling solutions, as well as for urbanization and equipment.

The system also features a great variety of shapes, textures and colors, having infinite combinations, thus obtaining human individuality in an industrialized system.

According to the overall concept of the integral, industrialized, modular dwelling system object of the present invention, concrete savings of up to 40% are achieved by substituting it with air as it is monolithically manufactured. This is achieved in part by using an arch center designed for creating cells in the concrete walls, according to the structural needs and which likewise allows to augment the walls' thickness and the module's width.

Figure 1:
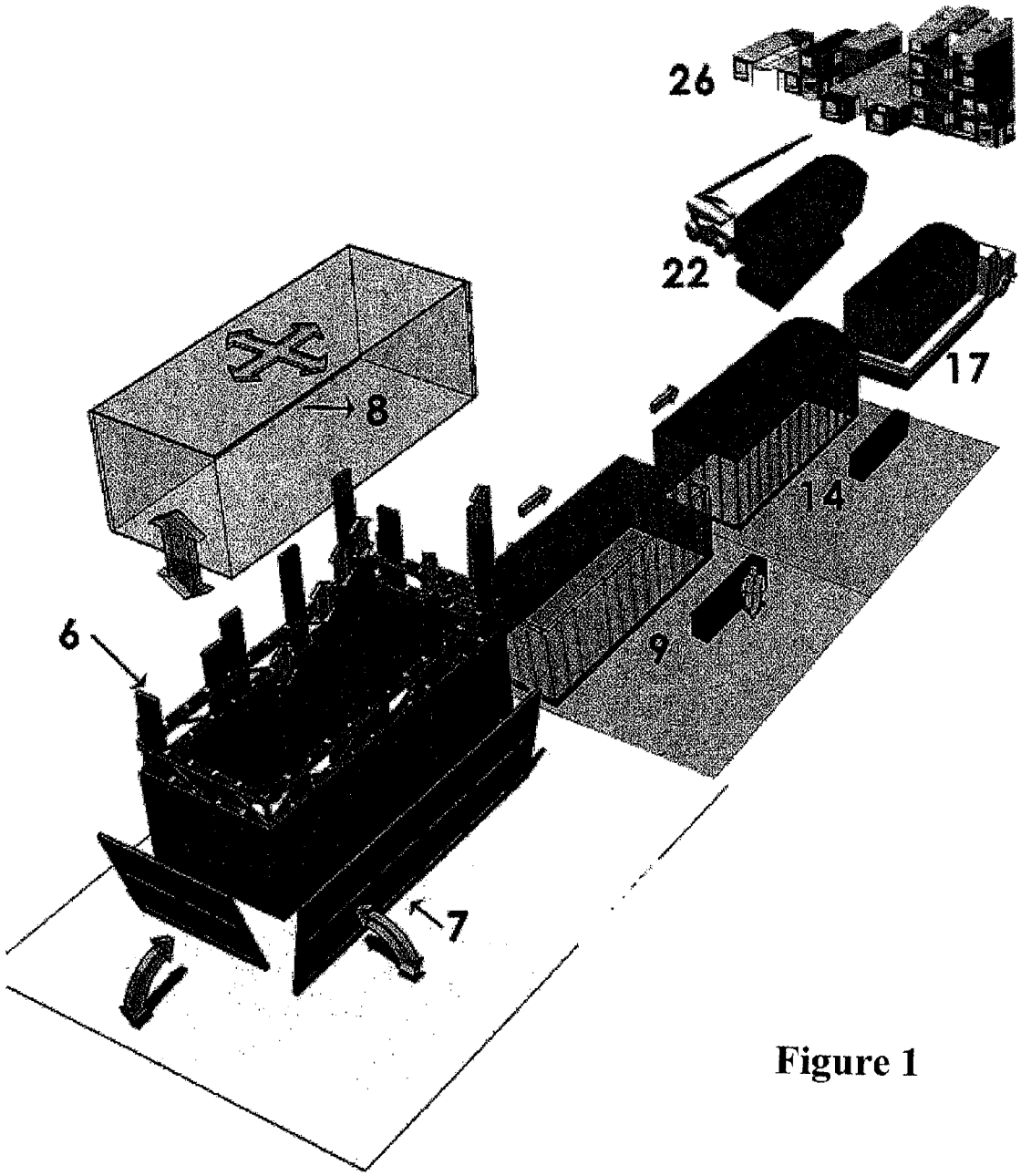
FIG. 1 shows a chart of the system's overall concept.

The overall concept of the invention can be summarized by the following sequence of steps illustrated in FIG. 1:

i) Assembly and installation of the inner retractable mold 8;

ii) Deployment of boundaries forming the outer mold 7;

iii) Placement of combs 6 at convenient distances in the gap formed between the inner mold 8 and the outer mold 7;

iv) Concrete casting into the gap formed between the inner 8 and outer 7 molds;

v) Curing of the molds 9;

vi) Finishes integration and final finishing 14;

vii) Shipping of modules to the construction-site 17;

viii) Deployment of modules on their site 22;

ix) Joining of modules 26.

DETAILED DISCLOSURE OF THE PROCESS

Production Process Synthesis

The module production process is done by the following sequence of steps:

Mold cleaning;

Steel and facilities enabling

Room and technical mold casting

Demolding

Module curing

Manufacturing and installation of finishes, windows, metal work and details

Final revision of the finished module.

Production Line

Factory

House manufacturing is a new concept of concrete prefabricated production that allows a production of 40 dwellings a day and 10,000 dwellings a year. The factory backbone is made up by an integral system of production, curing, finishing and stacking areas, modern high precision equipment, production, quality and organization control systems, and a logistics system for performing a production in carrousel system.

Each module (Residential and Technical), component or element is prefabricated into a system of multifunctional and flexible molds having very high geometrical precision of ±1.5 mm, integrating variable shapes of novel and esthetical textures by using integral or exterior color, which is made possible thanks to the use of autocompressible concrete (SCC). By means of a special pumping system in said modules, which is done from bottom to top and by using an adequate filling rate, elimination of air and realization of a fine surface finish are achieved. For flat members, the casting is done in the traditional way.

Figure 2:
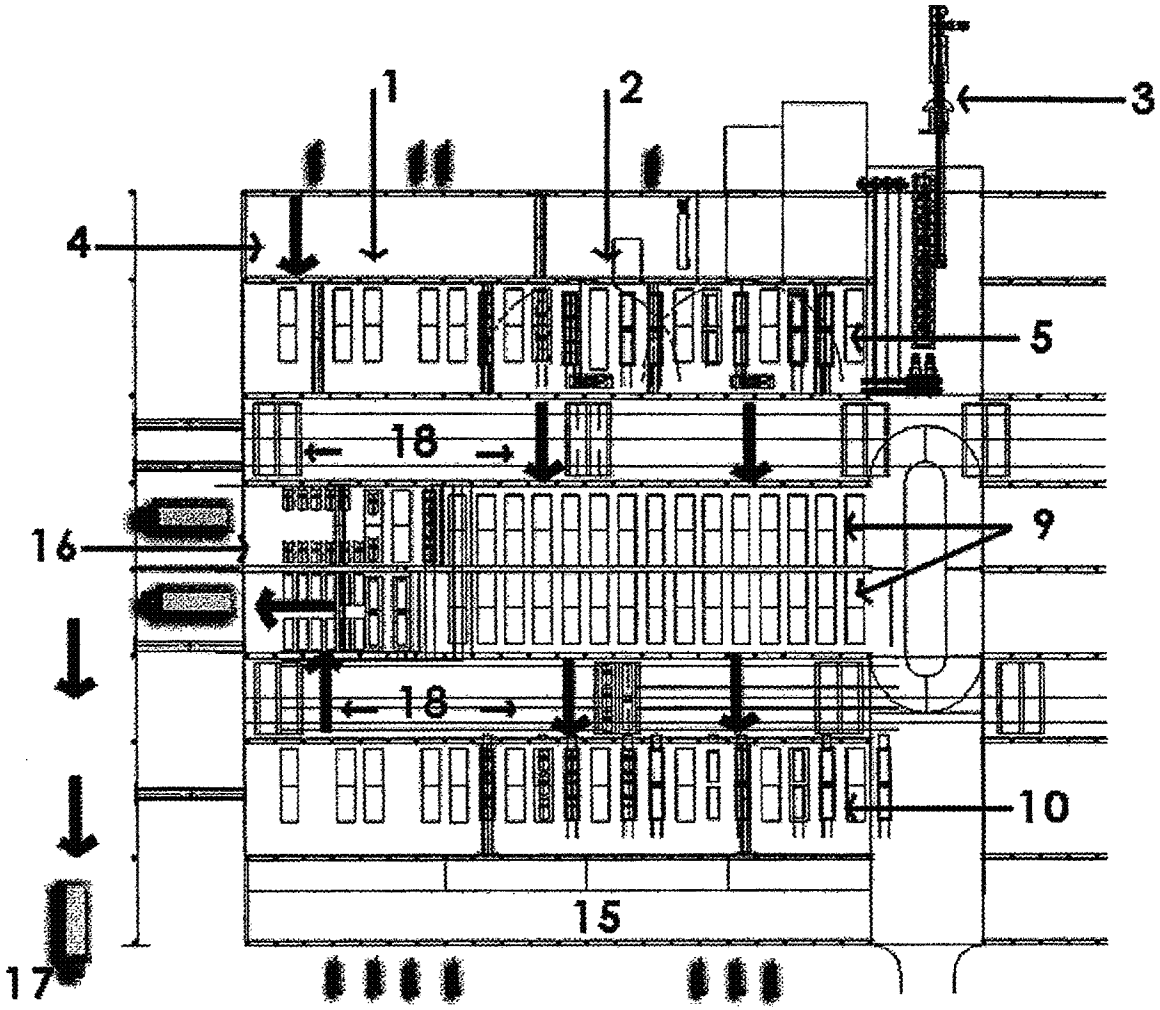
FIG. 2 is a diagram of the factory's production line.

FIG. 2 depicts a scheme of the factory production line, in which it can be seen the steel and installation preparation section 1, wherein reinforcing steel for said modules is prepared and welded with novel equipment and then prepared in the form of kits on racks for its easy and ordered installation. In the structures formed from said reinforcing steel installations and through elements or preparations are integrated. Steel overhead handling, as well as that of other materials, molds and stubs is done by mean of overhead cranes, which allow an adequate functionality and precision in the transportation and deployment thereof and allows the skilled worker to perform simple controls and minimal risk activities. Delivery area 2 can also be seen.

Concrete plant 3 is provided with planetary mixers and is the supplier of the autocompressible concrete at a high quality and mixture blending, including color. Concrete loads are cast therein into a hopper for homogenizing them and allowing their uniform distribution at pumping.

FIG. 2 also shows mold production area 4, the area in which on line prototype 5 casting takes place, the cast product rests in a first set stage, combs 6 of hollow walls, which were previously introduced in the mold for providing the necessary hollow gaps in the modules, are removed when the concrete has reached 5-7 MPa. At a second set stage, in a hardened concrete of about 15 MPa, the uncentering of outer boundaries and mold cores takes place. Then, the platform, base of the prefabricated products starts its shifting towards the final curing zone, that is, the area wherein cast molds 9 curing takes place. The final curing will last between 6-8 hours. The shifting is done by a wheel and track mobile system, which allows lateral and longitudinal movements preventing warping or over-strains in the prefabricated products.

In the continuation of the carrousel system, the next step of the process is the ingress to the area on which the modules detail and finishes preparation is performed. In this area the preparation 10, integration of fittings in furniture 11, prefabricated components 12 and painting 13 take place. The activities are done by working teams, thus avoiding interference by dividing into zones or groups. Working islets gather the installing and testing tools and equipment for achieving the final finishing. Once the final finishing is concluded, the platforms are shifted with the prefabricated products towards the storage and/or assembly zone 16 for being sent to the construction-site.

Factory Production Process

Figure 3:
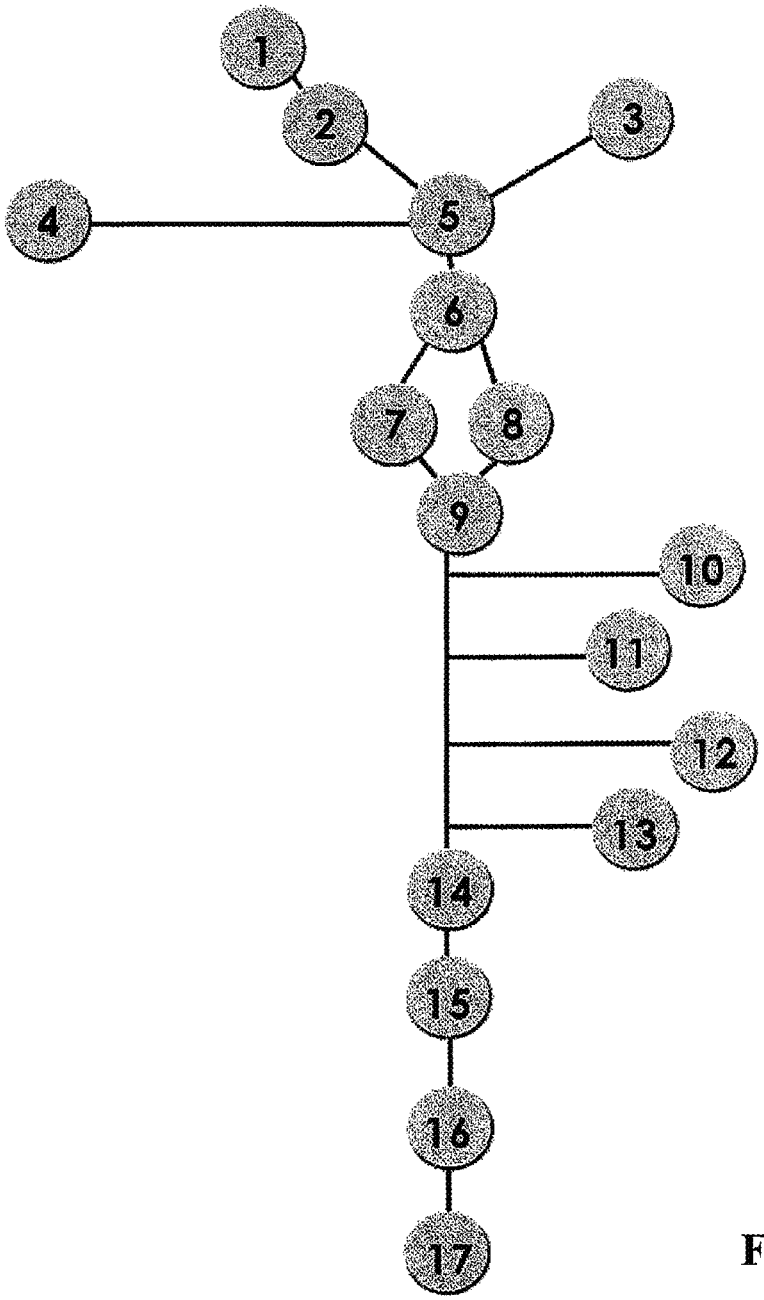
FIG. 3 is a flowchart of the on factory production process.

As can be seen in FIG. 3, the factory production process starts with the installation preparation 1, here, reinforcing steel of the modules is enabled 2 and welded and then prepared in the form of "kits" or sets and grouped in "racks" or shelves, for allowing an easy and ordered deployment thereof. Also, in the structures formed from said reinforcing steel are the necessary installations and through members or preparations integrated. Simultaneously at the concrete plant 3, autocompressible concrete which is to be poured into the molds from the mold production area 4 is prepared. In order to get to the mold casting area 5, the enabled reinforcing steel is carried by overhead cranes to be placed inside the molds which are transported from the mold production area 4. Once in position the reinforcing steel and molds, metallic combs 6 are introduced in place, then the concrete is poured by pumping. Next, combs 6 are removed from the hollow walls, this combs were previously introduced in the mold for providing the necessary void spaces in the modules. Here the cast product rests at a first set stage and the comb removal is done when the concrete has reached 5-7 MPa.

It then takes place the uncentering of outer boundaries 7 and of the retractable inner mold 8 and the mold cores. Then the already uncentered cast modules are transported by mobile platforms driven by a wheel and track mobile system which allows lateral and longitudinal movements, thereby preventing warping or over-strains in the prefabricated products. In the final curing area 9 the final curing step lasts between 6 and 8 hours. Continuing with the process, the following step consists in entering the area on which the modules detail and finishing preparation take place. In this area it is proceeded to the preparation 10, furniture accessories integration 11, prefabricated components 12, painting 13 and final finishing 14. Once the final finishing 14 has concluded, the platforms with the prefabricated products are moved to the storage 15 and/or assembly 16 zone for being sent to the construction-site 17.

Module Construction Process

As can be seen from FIGS. 27A and 27B, for constructing the modules the following series of steps or stages is performed:

a) Placing the slab centering 51;

b) Placing the laths and steel reinforcements 2 for slab and walls together with the installations;

c) Lowering the inner centering 8 such that it is seated around the slab centering 51 and inside the laths and steel reinforcements 2;

d) Expanding the inner centering 8 until it reaches the inner area intended for the module;

e) Placing the boundaries 7 of the outer centering, leaving a free gap between said boundaries 7 and the inner centering 8 corresponding to the intended thickness of the module wall;

f) Lowering said combs 6 such that they are loosely placed between the inner centering 8 and the boundaries of the outer centering 7, in order to create the air gaps at the time the module casting is done;

g) Pouring the concrete after said combs 6 are down at the intended position;

h) Removing the outer centering 7 when the desired set is achieved;

i) Rising said combs 6 for leaving free the honeycomb gaps formed during casting;

j) Retracting the inner centering 8 to separate it from the cast module inner wall;

k) Rising the inner centering 8 for leaving free the inside of the cast module;

l) Passing the finished module having an integral finish at the floors, to the set area;

m) Leaving the concrete to set and afterwards continuing the cast and set module travel to the installation area;

n) Preparing the details and finishes 10;

o) Integrating the furniture accessories 11;

p) Integrating the prefabricated components 12;

q) Painting the modules 13;

r) Effecting the modules final finishing 14.

Once the manufacturing process has ended, the already finished module is raised to the mobile platform 17 that will carry it to the construction-site, wherein a crane 21 shall place it at its final destination.

Construction Process Elements

It follows a detailed disclosure of the elements used in the factory production process.

Molds

The first elements to be considered are the molds, which are made of 8 mm steel sheeting which has been designed with the maximum structural efficiency. Its geometry allows to achieve a high finishing precision. The use of this material allows to obtain the high quality needed by the houses made of the integral, industrialized, modular dwelling system of the present invention. When a new mold is designed in the computer, the electronic data is transferred to a novel laser cutting machine. The operator here only controls the cutting process. This machine guarantees a precision of ±0.01 mm in the mold construction.

In the system of the present invention, the element that can be considered as the most important one and which allows the great flexibility and versatility of the system is a flexible mold which is used for casting monolithic concrete modules with the flexibility of being able to reduce the amount of material by a mechanic system that actuates some metallic cone-shaped combs which are located, as the structural needs require, inside the mold for being towed after casting, thus leaving cells inside the concrete volume.

The flexible mold is an integral system that can be adapted to the most varying module requirements, adjustable in every direction, length, width, height, thickness and comb amount and location.

Said flexible mold consists of:

(a) A retractable mold 8 suspended in a frame, which moves downwards and upwards thus working as an internal centering.

(b) An outer mold 7, divided in boundaries, which works as outer centering.

(c) A basket or frame 52 which, located in the upper part of said molds, works as comb support 6.

(d) A series of slightly tapered combs 6 which will fill in the space inside the mold, for being removed after casting and leaving air voids, thus reducing the amount of material. The amount and position of said combs 6 will be the result of a structural study specifically made for each module composed of different wall shapes, and which will make up the several prototypes.

Laser Cutting System and Metal Bending

The sheet needed for preparing the individual modules is cut by a laser cutting system consisting of a Trumpf Trumatic® series L4030 machine operating according to a traveling optic nozzle principle, in which the laser beam rod is moved over the working area. This allows to achieve very high processing speeds independent from the thickness of the material to be cut. The operator and laser control panels are integrated to the machine structure. There can be accessed from three sides in order to facilitate loading and unloading of material, as well as being able to simultaneously perform these steps in production avoiding dead times. The laser beam is a multifunctional tool, its main feature being to allow cutting a wide variety of materials having different thicknesses with high precision. The geometry of the cuts can be simple or complex because the laser has the capacity of leaving the piece ready for assembling.

Concrete Plant

The mixing plant is fitted with two or three planetary mixers for producing 600 $m^3$/day. This system allows to achieve a high quality concrete for obtaining high resistance and excellent quality surface finishes. With these equipments it is possible to produce Autocompressible Concrete (SCC), which allows to comply with said requirements. Said casting are also performed rapidly and easily. Likewise, it is also possible to comply with the tolerance in the best way as there is no need for the traditional vibration, thus lengthening the service life of the centering while achieving a high quality surface in the finished modules.

Pumping

Two pumps are needed which are connected to the concrete mixing bowl. These pumps are the endless screw kind of pumps. This equipment pumps concrete uniformly without exerting shock forces on it. This is a great advantage for the mold design. The machine is modularly constructed. All of its parts can be exchanged very quickly in case they become damaged. The pump is connected to the lower part of the mold in order to perform the injection from the lower part thereof. This pump-mold connection is mechanical and has a simple operation for performing a uniform dispensing of the whole element.

Production and Preparation of Reinforcing Steel and Meshing

The fully automatized production for producing custom made meshing by using a versatile welding system is the most efficient and economically feasible method for producing the reinforcement of about 23 ton/day and 200 $m^2$/hr. Quality is made possible with the exact positioning of the reinforcing inside the prefabricated product, thus simplifying the logistics for moving said material (perfect deployment and simplification of its positioning). Full compliance of the structural requirements is one of the main arguments in favor of this production method. From the several roll rotors, the machine is automatically fed of cable for automatically straighten and cut it, in order to achieve the required longitudinal and transverse bars regardless of their amount, length or gauge. The rotor-based straightening system has been fully tested and assures the constant processing both of cold and hot rolled materials, thus complying with the most stringent standards, which is a prerequisite for the plant as such (without problems and continuous operation).

A CAD-CAM (Computer assisted design/computer assisted manufacturing) controls the correct location of the bars which is done by a rack system having tongs and which places the transverse and longitudinal bars in the notches that exist on a intermeshed platform for welding the intersections that can be percentage-controlled. This system allows to prevent waste by being exact cuts of the bar length in order to make window and door passages.

The automatic rotable MSR 16 2 BK machine straightens, cuts and bends 4 to 16 mm gauge cold or heat rolled roll bar. The same will produce 15 ton/day.

The machine is designed for fulfilling the needs high production capacity plants demand, for which it is essential to make a rapid diameter change. The special features of this machine make it specially adequate for using in prefabricate production plants and steel preparation plants with a high degree of automation.

Curing

Curing of the cast molds is done in three phases or stages. The first and second 9 curing phases are performed at the very casting area and the third phase is done at the curing chamber or zone. Curing takes place naturally by setting the ambient temperature, taking care of relative humidity and keeping concrete's own heat by using heaters.

In all the concrete curing stages the necessary resistances have to be obtained in order to remove combs 6, drawing cores and removing side wall borders 7 or centering 8. In the first curing stage the resistance must be between 2 and 3 MPa which is necessary for drawing said combs; the second stage has the purpose of achieving sufficient concrete aging (7 MPa resistance) in order for the casting inside the mold to support movement towards the third curing area, this has the purpose for concrete to reach the sufficient maturity (15 MPa) in order for centerings 7 and 8 to be removed from said side walls.

It is necessary to protect the temperature generated by the chemical reaction occurring between cement and water by taking advantage thereof for curing the element. As an additional alternative cores could be heated to a temperature not higher than 40° C. in order for concrete to get higher resistances at early ages. In the tests and experiences that are currently being obtained, a canvas system for keeping temperature is being evaluated, although by the time said elements are introduced to the curing zone, the use of canvas is unnecessary.

From the stationary zone the element is shifted, already been uncentered from the cores and the outer walls, transporting it on the platform which is its base and that shall be kept during its whole travel up to reaching the storing point. In the abovementioned curing stages there is no lifting of the element because all the displacements are horizontal even when entering the standing zone in which it will stand for about 12 hours, the element then being moved to the following zone.

In-Factory Movements by Overhead Cranes

Overhead cranes are composed of steel frames and an adjustable high precision electromechanical engine which guarantees that the loads are always at the system's center of gravity. The capacity of these cranes has been chosen according to the loads to be handled ranging between 5 or 20 ton. Pulley adjustment is done by means of a rigid frame system and an electromechanical crane that can be adjusted in longitudinal position about ±750 mm. Centroidal balance is achieved by adjusting the position of the electromechanically operated charge (transverse) tie and the crane (longitudinal).

The dual rail of overhead cranes offers the lowest dead weight ratio in the system as it is distributes in two bearings the structure weight. They are also characterized by the excellent geometry thus assuring very favorable traveling features. The particularly big towing height is achieved due to the fact that the hook can pass between the main steel frames.

Assembling System

In order to perform the assembly of the elements a 100 ton. hydraulic crane is required. The gin pole or arm of the crane is formed by a structure that gives the adequate resistance for the loads but at the same time allows to have few wind resistance. Towing and lowering can be substantially performed with the aid of the engine although they can also be made with regulated descent and no engine, for all of them a hoist system is used. It has a dampening system which gradually reduces operational speed by avoiding jolting when beginning load towing or lowering.

Installations and Finishes

Preparation works for prefabricating installations need adequate tools, definition of all their elements and material disposition at the site in order to be able to perform rapid and good quality assemblies. All the piping is placed inside the concrete wall before performing the casting. In order to perform the prefabricated installations special scantlings are handled; workers can thus install piping having the corresponding bending and cutting, and afterwards placing the rapid union connections; with this is made possible an installation that can be places with a single movement, as a single element and tested. Preparing the electrical installation must be done directly in the mold. The cases or boxes are fixed by special connectors included in the mold such that their adequate defined position is assured, thus reducing the risk of human errors and speeding up the setting process. The polyduct contains the wiring and is directly attached to the steel structure by using a trolley carrying all the tooling, connectors and material required for making the installation; each of them has a predetermined place inside the trolley for being easily located.

Paint application is done by means of a sprinkler system, this can be achieved because the wall surface finishing is adequate for achieving a uniform application.

Shipping and Deployment at Construction-Site

Technical and housing modules are shipped to the construction-site (or future growth) by trucks with specially designed platforms.

Modules are places on prefabricated foundations, by means of a crane located at the construction-site, for simply assembling the dwellings by screwing the joints, that is by "dry work".

For future growth the required module is likewise shipped with the difference that the crane is included inside the shipping truck.

Module Placing at Construction-Site

Shipping to the Construction-Site

The element is towed by placing it on the transporting equipment, the covering wall being then placed with the intention of shipping the two elements at the same time and thus reduce transportation and towing costs and in order to simplify the logistics. The transport then heads to the assembly site. For optimizing shipping use is made of feed type equipment, which are two trailers on which the two elements are shipped thereby optimizing travels. At the assembly place there is a Terex 1000 caterpillar track crane which due to its load movement control allows a uniform movement without sudden jolts, likewise, a rocker for the automatic regulation of the loading centroid is used that allows to easily position the element at the desired place; this positioning is guided by bridle joint type connectors which are embedded in the modules forming the dwellings, which serve as guides and attaching elements in order to achieve a 1.5 mm tolerance.

First Floor Assembly and Growth

In the case of growths a trailer-crane transport is used that allows to rapidly tow the growth module; in order to position it; first the deck roof slab of the ground floor is removed and the growth element is placed for then placing again the slab which formerly was from the ground floor on the growth module thus forming the deck roof slab of the second story.

Figure 4:
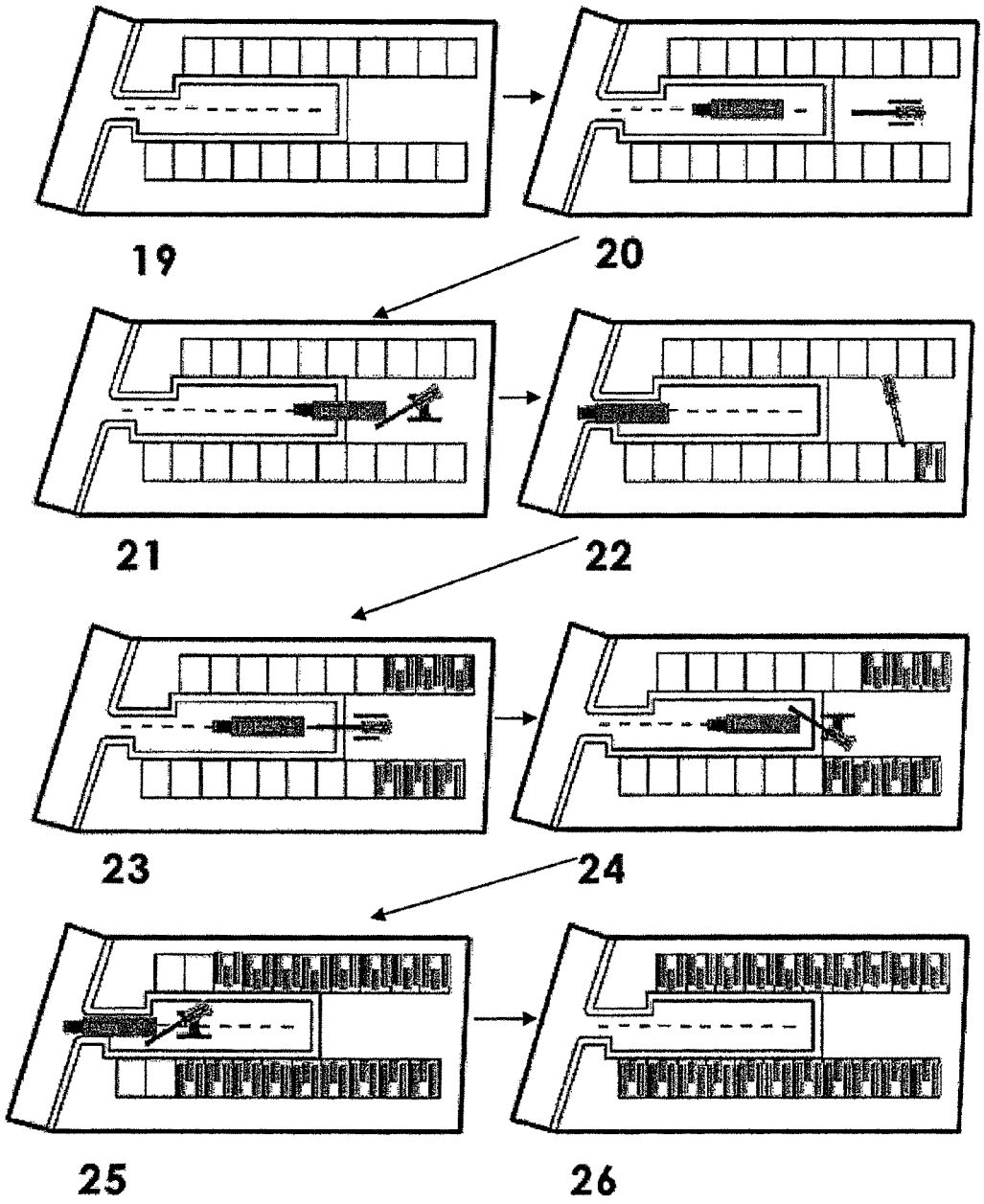
FIG. 4 is a diagram of the step sequence performed to install the modules in construction-site.

FIG. 4 shows a diagram of the step sequence used for positioning the modules on the construction-site, wherein, after urbanizing and placing the slab 19, the platform with the modules 20 is entered; then the crane rises the modules 21, for immediately placing the modules on place 22 and the empty platform is removed; the crane advances 23 at the construction-site; the process is repeated 24, 25 until the cell is finished 26.

REALIZATION EXAMPLES

Example 1

Economical Dwelling

Figure 5:
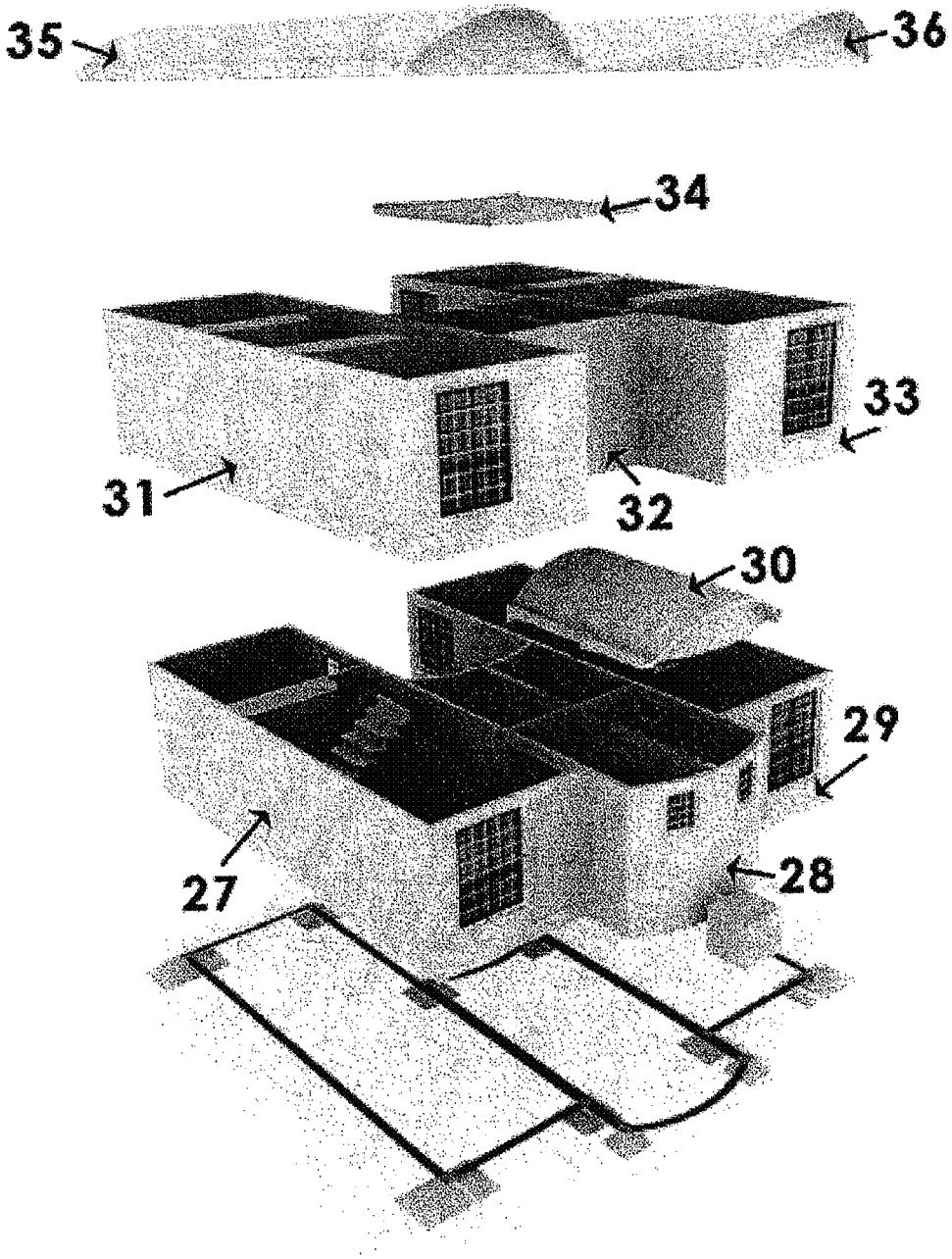
FIG. 5 is an exploded perspective view of an economical dwelling according to present invention.

For comprising the constructive system one of the dwellings is used, such as can be seen in FIG. 5, for exemplifying the process, the pieces and their components.

The illustrated economical dwelling is made up from a duplex type house, that is two dwellings that share a common central wall, which for illustration purposes shall be identified as right or left in terms of their orientation from the inside of the dwellings, which has a right, ground floor residential module 27, a ground floor technical module 28 and a left, ground floor residential module 29. Above the technical module 28 a ground floor technical module vault slab 30 is placed.

Above the ground floor modules a right, upper floor residential module 31, an upper floor technical module 32 and a left, upper floor residential module 33 are placed. Above the upper floor modules a right residential module wall 35, an upper floor technical module slab 34 and left, upper floor residential module slab 36 are respectively placed.

It is important to remember that the system is so versatile that a huge variety of dwellings and urban elements could be created under this same concept.

Upper Floor Modules

Figure 6:
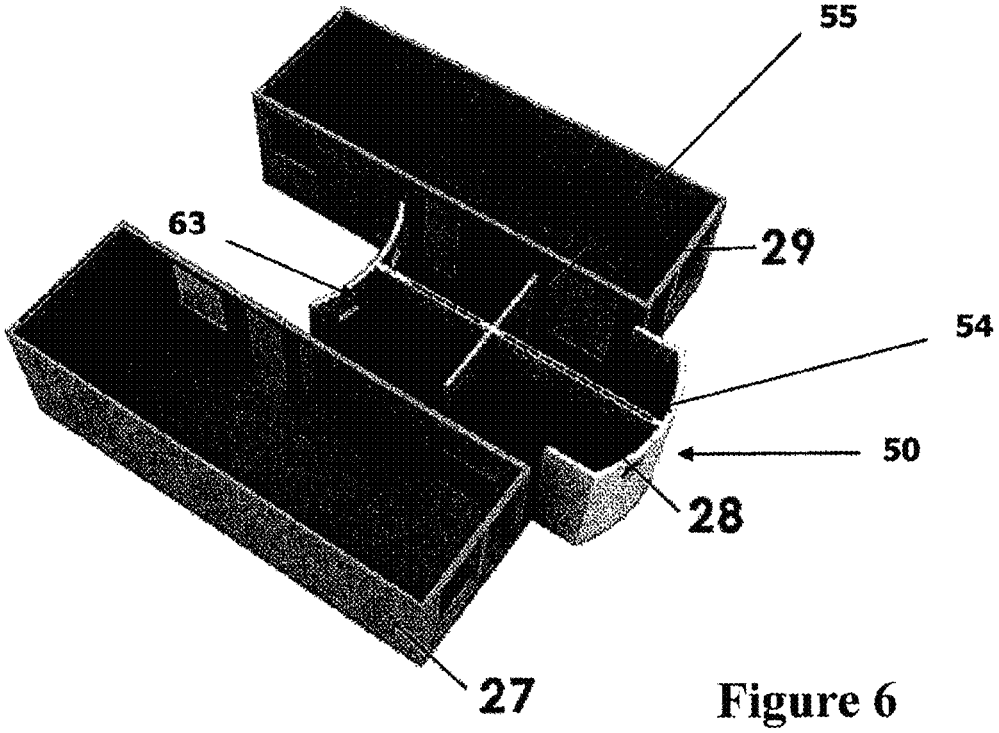
FIG. 6 is a top perspective view of a ground floor module.

FIG. 6 shows the modules being identified in two main categories:

- Habitable residential modules (living room, dinning room, bedroom with built-in closet); and
- Technical modules (installations, bathroom and kitchen, domestic service patio).

Ground Floor Residential Modules

Figure 7:
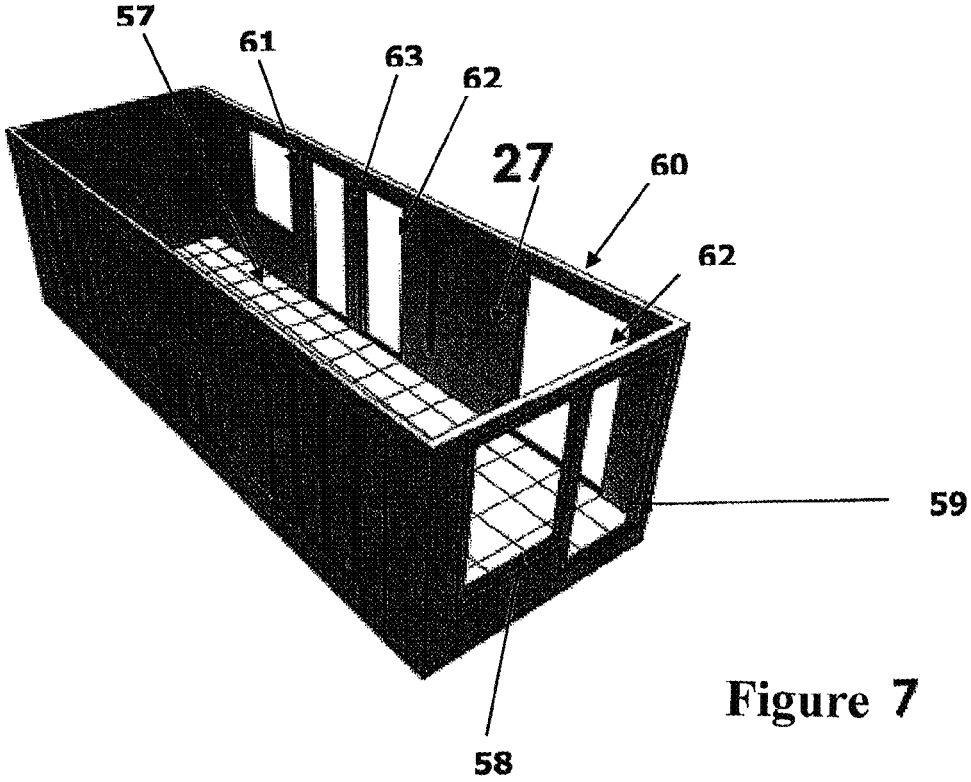
FIG. 7 is a perspective view of a ground floor residential module.

FIG. 7 shows a perspective view of a ground floor residential module 27. Each ground floor residential module 27 and 29 is monolithically formed and embodies a floor 57 which since its casting has the desired finishes. On their front surface they have a façade with windows 58 and door 59 which were formed during the casting of the respective modules. Said modules 27 and 29 have on their corresponding wall 60 which is oriented inwardly, the areas corresponding to the windows which face to a central hall 61 and the communication doors between modules 62 and for exiting to the hall 63.

Ground Floor Technical Module

Figure 8:
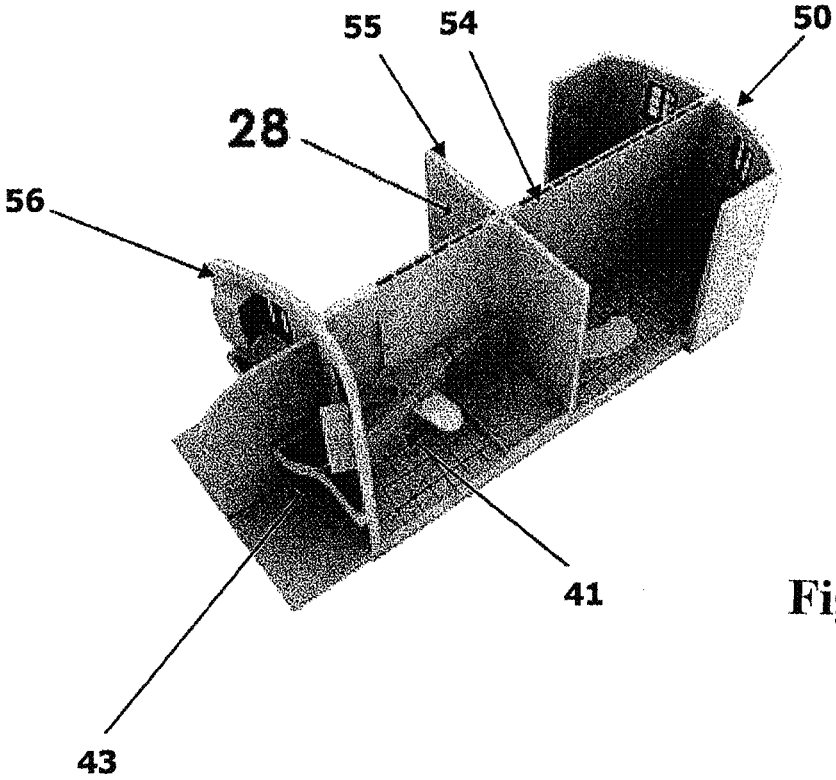
FIG. 8 is a perspective view of a ground floor technical module.

As can be seen in FIGS. 6, 7 and 8, the ground floor technical module 28 is shared by the two residential modules 27 and 29 and comprises a monolithic modular structure divided by a transversal wall 55 and by a longitudinal wall 54 which separates bathrooms from kitchens located at the ground floor of the two dwellings. In FIG. 8 it is particularly seen that the wall 54 longitudinally dividing the two ground floor technical modules has a wall having cells formed during the casting of said module.

On the rear side of the technical modules, seen from the front of the dwelling, there are bathrooms 65 in which the left 41 and right 42 bathroom-kit components are installed which can be seen in more detail in FIGS. 14 and 15. On the rear part of the ground floor technical module 28 and specifically on the rear wall 56 facing to the patio the respective right 43 and left 44 washing sink corresponding components are placed, for the ground floor technical module, which can also be seen with more detail in FIGS. 16 and 17. On the front part of the ground floor technical module 28 the façade 64 of said module is located.

Upper Floor Modules

As the ground floor, the upper floor is formed by an upper floor technical module 32 and two right 31 and left 33 residential modules.

Upper Floor Residential Modules

Figure 9:
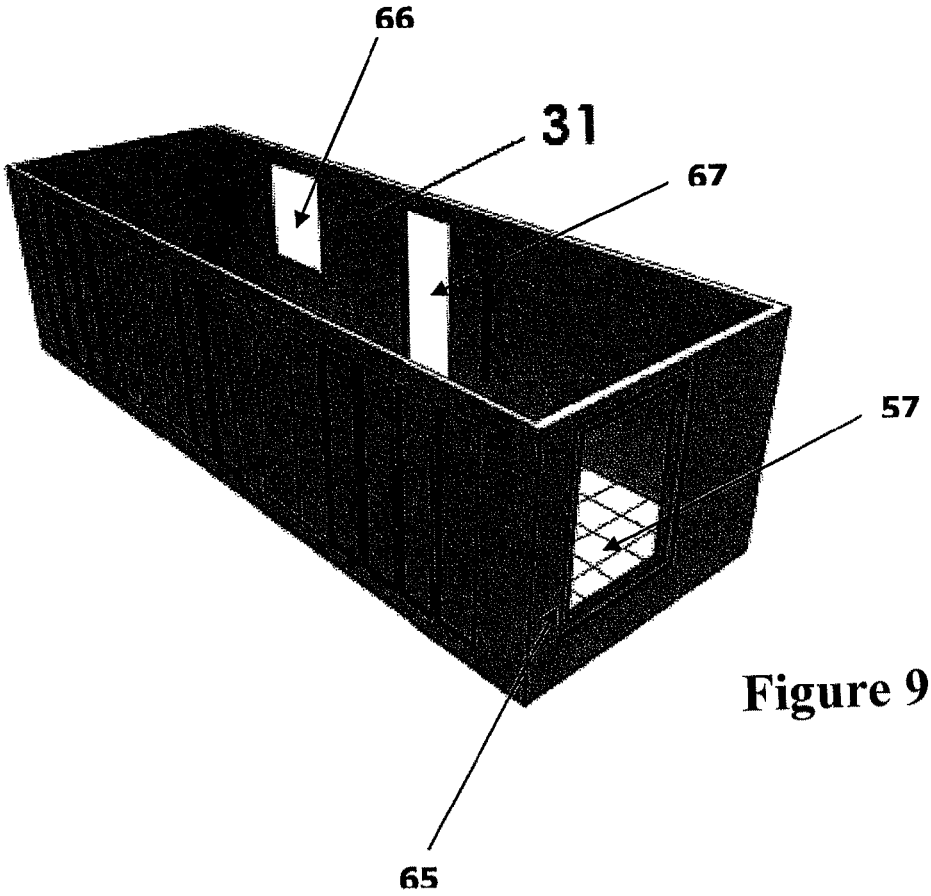
FIG. 9 is a perspective view of a residential upper floor module.
Figure 10:
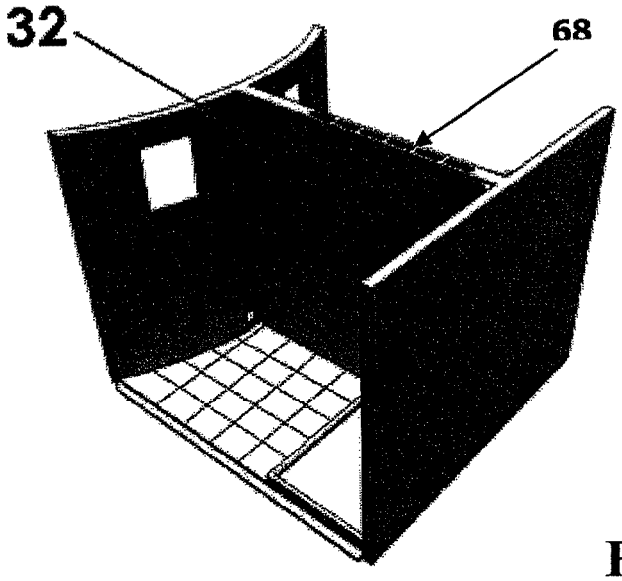
FIG. 10 is a perspective view of an upper floor technical module.
Figure 11:
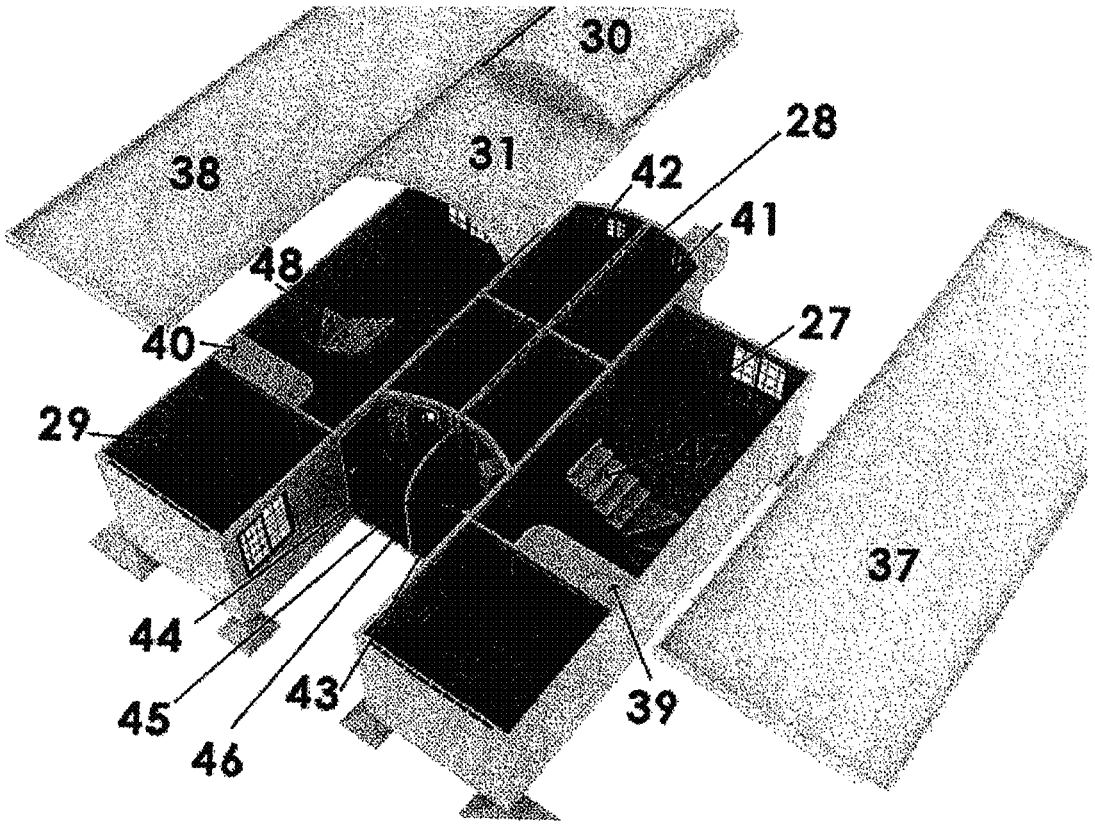
FIG. 11 is an exploded top perspective view wherein the components and slabs of the integral, industrialized, modular dwelling system according to the present invention can be seen.

FIG. 9 shows a conventional perspective view of a right, upper floor residential module 31 in which flooring finishes 57 which were installed since the module casting are shown, there is also seen a front window 65, a rear window 66 and an inter-module communication door 67.

The left, upper floor residential module corresponds to a mirror image of the right module.

Upper Floor Technical Module

The upper floor technical module is a monolithic structure having a longitudinal wall 68 separating the bathrooms from the corresponding right and left modules.

Components and Slabs

Closet Component

FIGS. 12A, 12B show the bedroom built-in closet or wardrobe components of the right residential module, and FIGS. 13A and 13B depict the same type of component for the left residential module.

Bathroom Kit Component

FIGS. 14 and 15 show in detail the left 41 and right 42, bathroom kit components, which are installed in the technical module when being cast.

Washing Sink Component

The right 43 and left 44 ground floor technical module washing components which are generally embedded in the rear wall 56 of the ground floor technical module are clearly seen on FIGS. 16 and 17, respectively.

Patio Wall and Roof Components

FIG. 18 shows a conventional perspective view of the patio wall component 45, while FIG. 18 in turn shows the patio roof component 46, both monolithically formed for being installed in situ when assembling the dwelling.

Stair Component

Stair components for the left residential module 47 and for the right residential module 48, such as can be seen in FIGS.

20 and 21, are particularly special and self-supportingly designed and made for not affecting the dwelling's structure. Slabs FIGS. 23A and 23B show respectively upper and lower views of a slab for ground level residential module 37.

Vault slab 30 for the lower floor technical module can be seen in FIG. 24.

FIGS. 25A and 25B depict respectively right and left upper floor residential slabs 37.

Finally, FIG. 26 shows a flat slab for upper floor technical module, in which it can be clearly seen the lower ribs which provide it with the necessary resistance.

FIG. 22 clearly shows a modular dwelling wherein the possibility of using different wall, façade and slab embodiments can be seen, in order to give individuality to each dwelling.

The present invention has been clearly disclosed and illustrated according to the preferred embodiment of the invention only for clarity and understanding purposes. It is to be understood from this that no unnecessary limitations must exist. The invention is not limited to the exact details shown and disclosed, and therefore included are all the obvious variations for a person skilled in the art to which this invention belongs defined by the following claims.

The invention claimed is:

1. An integral system for manufacturing industrialized modular dwelling, consisting of a factory for on line production of different kind modules comprising reinforced concrete modules, to be afterwards assembled in situ for constructing dwellings, characterized by consisting of a carrousel system comprising:

a delivery area in which material needed for manufacturing said modules is received;

a steel and installation preparation section in which reinforcing steel for the reinforced concrete modules is prepared and welded and afterwards assembled and arranged in a form of kits on racks;

a concrete plant provided with planetary mixers and which provides high quality autocompressible concrete and mixture blending, including color addition;

a mold production area in which molds for casting the reinforced concrete modules are formed and prepared for casting;

a casting area in which casting of the reinforced concrete modules is performed on line;

a final curing zone in which curing of the cast reinforced concrete modules takes place;

a wheel and track mobile system, which provides lateral and longitudinal movements preventing warping or over-strains in prefabricated products;

a zone for preparing the details and finishes of said reinforced concrete modules which in turn comprises a preparation area; a furniture accessories integration area; a prefabricated component integration area; and a painting area; and a storage and/or assembly zone in which said fabricated reinforced concrete modules are stored for their later delivery to a construction-site.

2. The integral system for manufacturing industrialized modular dwelling according to claim 1, wherein installation and through elements or preparations are integrated in the structures and are formed from reinforcing steel.

3. The integral system for manufacturing industrialized modular dwelling according to claim 1, wherein steel overhead handling, as well as that of other materials, molds and stubs, is provided by overhead cranes, which allow an adequate functionality and precision in the transportation and positioning of said steel, other materials, molds and stubs.

4. The integral system for manufacturing industrialized modular dwelling according to claim 1, wherein said wheel and track mobile system provides a displacement from the casting area to the final curing zone, which allows lateral and longitudinal movements preventing warping or over-strains in the prefabricated products.

* * * * *